US012275570B2

(12) United States Patent
Oesterle et al.

(10) Patent No.: US 12,275,570 B2
(45) Date of Patent: Apr. 15, 2025

(54) SEPARATOR BEADS FOR MANUFACTURED CONCRETE PRODUCTS

(71) Applicant: ACM Chemistries, Inc., Norcross, GA (US)

(72) Inventors: Matthew Oesterle, Flowery Branch, GA (US); Craig Walloch, Peachtree Corners, GA (US); Marshall L. Brown, Berkeley Lake, GA (US); Ted Light, Suwanee, GA (US); Dean Jurik, Mesick, MI (US)

(73) Assignee: ACM Chemistries, Inc., Norcross, GA (US)

( * ) Notice: Subject to any disclaimer, the term of this patent is extended or adjusted under 35 U.S.C. 154(b) by 517 days.

(21) Appl. No.: 17/671,908

(22) Filed: Feb. 15, 2022

(65) Prior Publication Data

US 2022/0274760 A1 Sep. 1, 2022

Related U.S. Application Data

(60) Provisional application No. 63/154,301, filed on Feb. 26, 2021.

(51) Int. Cl.

| | |
|---|---|
| ***B65D 81/09*** | (2006.01) |
| ***B65D 65/46*** | (2006.01) |
| ***B65D 85/46*** | (2006.01) |

(52) U.S. Cl.

CPC ..... *B65D 81/09* (2013.01); *B65D 65/466* (2013.01); *B65D 85/46* (2013.01); *B65D 2581/056* (2013.01); *B65D 2585/30* (2013.01)

(58) Field of Classification Search

None

See application file for complete search history.

(56) References Cited

U.S. PATENT DOCUMENTS

2019/0283275 A1* 9/2019 Sumi ..... B29B 7/48

FOREIGN PATENT DOCUMENTS

EP 3 604 148 2/2020

* cited by examiner

*Primary Examiner* — Shawn Mckinnon

(74) *Attorney, Agent, or Firm* — HSML P.C.

(57) ABSTRACT

A separator bead is disclosed for separating layers of manufactured concrete products, wherein the separator bead is characterized in that: the separator bead is preferably fabricated from a biodegradable bead material; the separator bead is configured with a thickness selected from 2 mm to 5 mm, a width selected from 2 mm to 10 mm, a depth selected from 2 mm to 10 mm, and a thickness-to-width aspect ratio selected from 0.2 to 0.9; the separator bead is preferably configured with one or more nodules, each with a nodule diameter selected from 0.01 mm to 2 mm; and the separator bead is characterized by a thickness compression from 5% to 50%, under a load of 60 lb per bead at a temperature of 120° F. for 5 minutes. The disclosed separator beads overcome known problems in the art of manufactured concrete products. The optimized separator beads prevent surface scratches and defects.

23 Claims, 6 Drawing Sheets

FIG. 3

| Material | Thickness (mm) | Width (mm) | Length (mm) | % Compression[1] at Room Temperature | % Compression[1] at 120°F | Aspect Ratio[2] | Shape | Slip Angle | Coefficient of Friction | Cement/water Staining | Material Type |
|---|---|---|---|---|---|---|---|---|---|---|---|
| A | 2.6 | 5.3 | 3.4 | 11% | 17% | 0.49 | ACM die | 31 | 0.61 | None | Bio Degradable |
| B | 2.4 | 4.8 | 3.5 | 8% | 12% | 0.49 | ACM die | 33 | 0.64 | None | Bio Degradable |
| C | 2.7 | 3.7 | 2.4 | 4% | 25% | 0.72 | Cut cylinder | 23 | 0.43 | Moderate | Bio Degradable |
| D | 3.0 | 3.4 | 3.9 | 2% | 16% | 0.88 | Cut cylinder | 22 | 0.40 | Minimal | Bio Degradable |
| E | 2.1 | 3.7 | 5.0 | 13% | 19% | 0.57 | Flattened oval | 32 | 0.63 | None | Recycled |
| F | 2.7 | 5.6 | 5.6 | 11% | 17% | 0.48 | Saucer shape | 28 | 0.53 | None | Recycled |
| G | 1.4 | 3.9 | 4.3 | 29% | 36% | 0.37 | Ribbon-like | 32 | 0.63 | None | Bio Degradable |
| H | 2.2 | 4.7 | | 11% | 16% | 0.47 | Saucer shape | 30 | 0.58 | Heavy | Bio Degradable |

[1] % Compression = Percent reduction of initial bead thickness at a load of 60 lb per bead for 5 minutes

[2] Aspect ratio = Thickness/Width (before compression)

SEPARATOR BEADS FOR MANUFACTURED CONCRETE PRODUCTS

PRIORITY DATA

This patent application claims priority to U.S. Provisional Patent App. No. 63/154,301, filed on Feb. 26, 2021, which is herein incorporated by reference herein.

FIELD

The present invention generally relates to manufactured concrete products and systems, methods, stacked structures, and manufacturing/storage/shipping logistics associated with manufactured concrete products.

BACKGROUND

"Manufactured concrete products" are objects or structures that contain concrete and that are manufactured for purposes of installing the objects or structures at another site. That is, manufactured concrete products differ from concrete structures (e.g., a foundation slab) that are poured and cured at a job site. There are many examples of manufactured concrete products, including (but not limited to) pavers, tiles, slabs, blocks or concrete masonry units, bricks, and segmental retaining wall units.

Manufactured concrete products are typically produced using zero-slump dry-cast concrete on high-production machinery. Manufactured concrete products may also be made using wet-cast concrete poured into flexible molds to form slabs, for example.

While manufactured concrete products are bought for their utility, the products are often employed in architectural applications for which appearance and beauty are of paramount importance. Therefore, in the process of packaging manufactured concrete products, the surfaces of each product piece (also known as a "unit" in the industry) should be protected to preserve the aesthetics of the pieces by preventing scratching and damage to the surfaces of the individual pieces. Surface protection keeps customers happy and minimizes the waste created from scarred or damaged pieces.

Conventionally, at a manufacturing plant, layers of manufactured concrete products are stacked on top of one another, usually on a pallet, to form a plurality of unit layers known as a "cube" (which is not necessarily cubical). The bottom of the unit above will scratch the face of the unit underneath during transit if there is nothing between the layers. The industry has developed and implemented various techniques to separate the bottoms and faces of adjacent layers to protect the surfaces. These techniques include sheets or strips of plastic foam, sheets of plastic mesh, sheets of nonwoven polymer fabrics, or other separator sheets.

Another reason to separate the unit layers is to allow for air circulation. Air circulation is important because the units are often packaged while they are moist and still curing. Trapped moisture can dissolve calcium hydroxide, which is a natural byproduct of Portland cement hydration; aqueous calcium hydroxide can migrate to the surface of the units where calcium hydroxide reacts with carbon dioxide in the air, forming calcium carbonate. This calcium carbonate is white and is known in the industry as efflorescence. Although not damaging, the white deposits cause white haze or concentrated white areas that detract from appearance, usually requiring cleaning with acid-based cleaners once the units are installed. Use of foam sheets, plastic mesh, nonwoven polymer fabric, or other separator sheets may provide adequate separation of layers to keep them from scratching, but the sheets tend to trap moisture—leading to efflorescence deposits on the units.

Another disadvantage of separator sheets is that during installation at the jobsite, a whole layer of units must be removed along with a separator sheet before the units in the layer below can be accessed for installation. This drawback hinders the installer who often desires to take units from several layers during the installation process.

To overcome the limitations of separator sheets, some producers have started to use plastic pellets that are broadcast onto unit layers during packaging. The plastic pellets keep the units surfaces separated to prevent scratching while allowing air to circulate between the layers, to minimize the formation of efflorescence, and to eliminate the need to remove each whole layer before accessing the lower unit layers during installation.

However, the plastic pellets are not designed and manufactured specifically for separating layers of manufactured concrete products. Rather, conventional plastic pellets are industrially fabricated as a feedstock for injection molding or other polymer processing. In the art of injection molding, pure resin plastics are manufactured into pellets of various shapes and sizes that allow for the easiest processing of these materials into finished goods during the injection-molding process. These pellets are manufactured by melting a polymer resin, extruding the melted resin through a die, and cutting an extrudate, either in or out of water, to form sphere-like shapes such as 5-mm spherical pellets for feeding to an injection-molding process. Commercially available plastic pellets have characteristics that limit their usefulness for separating layers of manufactured concrete products.

For example, materials available on the market include a very thin ribbon-like material that tends to stick to the surface, is too thin to provide adequate separation of the layers, and has the tendency to land on top of one another when applied, resulting in uneven, non-stable layers. Another known material is lentil-shaped and has the tendency to adhere to the surface, is too thin for separation of the layers, and leaves a stain when exposed to the elements.

In view of the aforementioned needs, there is a need for a solution that provides both (a) sufficient physical separation between adjacent layers of manufactured concrete products as well as (b) sufficient air circulation inside a cube of manufactured concrete products so that they naturally dry and do not form efflorescence. It is especially desired that separators would not adhere to the surface, not leave a stain, and be thick enough to provide adequate separation and air circulation while not allowing slip between layers.

SUMMARY

The present invention addresses the aforementioned needs in the art, as will now be summarized and then further described in detail below.

Some variations provide a separator bead for separating layers of manufactured concrete products, wherein the separator bead is characterized in that:

(a) the separator bead is fabricated from a bead material;

(b) the separator bead is configured with an oval or oval-like two-dimensional cross section defined by a bead thickness and a bead width, wherein the bead thickness is selected from about 2 mm to about 5 mm, and wherein the bead width is selected from about 2 mm to about 10 mm;

(c) the separator bead is configured with a bead depth that is perpendicular to each of the bead thickness and the bead width, wherein the bead depth is selected from about 2 mm to about 10 mm;

(d) the separator bead is configured with a bead thickness-to-width aspect ratio selected from about 0.2 to about 0.9;

(e) the separator bead is optionally configured with one or more nodules, each with a nodule diameter selected from about 0.01 mm to about 2 mm; and (f) the separator bead is characterized by a thickness compression from about 5% to about 50%, under a load of 60 lb at a temperature of 120° F. for 5 minutes.

In some embodiments, the bead thickness is selected from about 2 mm to about 4 mm, such as about 2.4 mm to about 3.5 mm.

In some embodiments, the bead width is selected from about 3 mm to about 6 mm, such as from about 4 mm to about 5 mm.

In some embodiments, the bead depth is selected from about 2 mm to about 8 mm, such as from about 3 mm to about 6 mm.

In some embodiments, the bead thickness-to-width aspect ratio is selected from about 0.4 to about 0.7, such as from about 0.4 to about 0.6, or from about 0.45 to about 0.55.

The separator bead may be characterized by a depth-to-thickness ratio selected from about 0.4 to about 10. The separator bead may be characterized by a depth-to-width ratio selected from about 0.5 to about 5.

The separator bead is preferably configured with one or more nodules. The number of nodules may vary, such as 2, 3, 4, or more. The nodule diameter may be selected from about 0.1 mm to about 1 mm, such as from about 0.2 mm to about 0.8 mm. The nodule aspect ratio (nodule diameter divided by bead thickness) may be selected from about 0.01 to about 2, such as from about 0.05 to about 1, or from about 0.1 to about 0.5, for example.

The bead material preferably includes, or consists essentially of, a biodegradable or compostable material.

The separator bead is designed to be capable of withstanding a load of 60 lb at a temperature of 120° F. for 5 minutes. In some embodiments, the separator bead is characterized by a thickness compression of about 10% to about 40%, under a load of 60 lb at a temperature of 120° F. for 5 minutes. In some embodiments, the separator bead is characterized by a thickness compression from about 1% to about 40%, such as from about 5% to about 30%, under a load of 60 lb at room temperature for 5 minutes.

In some embodiments, the separator bead is characterized by essentially no discoloration when stored in cement-saturated water at 120° F. for 7 days.

Some variations of the invention provide a system comprising multiple layers of manufactured concrete products and a plurality of separator beads disposed between each of the multiple layers, wherein each of the plurality of separator beads is characterized in that:

(a) the separator beads are fabricated from a bead material;

(b) the separator bead are configured with an oval or oval-like two-dimensional cross section defined by a bead thickness and a bead width, wherein the bead thickness is selected from about 2 mm to about 5 mm, and wherein the bead width is selected from about 2 mm to about 10 mm;

(c) the separator beads are configured with a bead depth that is perpendicular to each of the bead thickness and the bead width, wherein the bead depth is selected from about 2 mm to about 10 mm;

(d) the separator beads are configured with a bead thickness-to-width aspect ratio selected from about 0.2 to about 0.9;

(e) the separator beads are optionally configured with one or more nodules, each with a nodule diameter selected from about 0.01 mm to about 2 mm; and (f) the separator beads are characterized by a thickness compression from about 5% to about 50%, under a load of 60 lb per separator bead, caused by the multiple layers, at a temperature of 120° F. for 5 minutes.

In typical embodiments, the multiple layers are disposed in a vertically stacked arrangement. The number of layers may vary, such as at least 2, 3, 4, 5, 6, 7, 8, 9, 10, 11, 12, 13, 14, 15, 15, 16, 17, 18, 19, 20, or more.

In preferred embodiments, the separator beads do not significantly trap moisture between the separator beads and surfaces of the manufactured concrete products. In preferred embodiments, the multiple layers are sufficiently separated by the separator beads to enable drying via air circulation, thereby avoiding efflorescence.

In some systems, the separator beads are characterized by a coefficient of friction, relative to a surface of the manufactured concrete products, of at least about 0.4, such as at least about 0.5 or at least about 0.6.

In some systems, the separator beads are disposed between each of the multiple layers with a bead density of from about 0.01 to about 10 beads per square inch of layer area.

In some systems, the bead thickness is selected from about 2 mm to about 4 mm, such as from about 2.4 mm (e.g., Material B of Example 1) to about 3.5 mm. In some systems, the bead width is selected from about 3 mm to about 6 mm, such as from about 4 mm to about 5 mm. In some systems, the bead depth is selected from about 2 mm to about 8 mm, such as from about 3 mm to about 6 mm. The bead thickness-to-width aspect ratio may be selected from about 0.4 to about 0.7, such as from about 0.4 to about 0.6, or from about 0.45 to about 0.55. The separator beads may be characterized by a depth-to-thickness ratio selected from about 0.4 to about 10 and/or a depth-to-width ratio selected from about 0.5 to about 5.

In some systems, some or all of the separator beads are configured with one or more nodules, such as at least 2, at least 4, or at least 6 nodules. The nodule diameter may be selected from about 0.1 mm to about 1 mm, such as from about 0.2 mm to about 0.8 mm. The nodule aspect ratio (nodule diameter/bead thickness) may be selected from about 0.01 to about 2, such as from about 0.05 to about 1, or from about 0.1 to about 0.5.

In preferred systems of the invention, the bead material includes a biodegradable or compostable material, and more preferably consists essentially of a biodegradable material.

Preferably, the separator beads (or at least a majority of them) are each capable of withstanding a load of 60 lb per separation bead at a temperature of 120° F. for at least 5 minutes. In some systems, the separator beads are characterized by a thickness compression of about 10% to about 40% under a load of 60 lb per separator bead, caused by the multiple layers, at a temperature of 120° F. for 5 minutes. In some systems, the separator beads are characterized by a thickness compression selected from about 1% to about 40%, such as from about 5% to about 30%, under a load of 60 lb per separator bead, caused by the multiple layers, at room temperature (about 70° F.) for 5 minutes.

The separator beads are preferably characterized by no discoloration when stored in cement-saturated water at 120° F. for 7 days. This property is an indicator that the separator beads will not discolor (stain) surfaces of the manufactured concrete products during transport and storage.

Other variations provide a method of stacking multiple layers of manufactured concrete products, the method comprising:

providing manufactured concrete products;

stacking the manufactured concrete products into multiple layers; and between each of the multiple layers, introducing a plurality of separator beads, wherein each of the plurality of separator beads is characterized in that:

(a) the separator beads are fabricated from a bead material;

(b) the separator bead are configured with an oval or oval-like two-dimensional cross section defined by a bead thickness and a bead width, wherein the bead thickness is selected from about 2 mm to about 5 mm, and wherein the bead width is selected from about 2 mm to about 10 mm;

(c) the separator beads are configured with a bead depth that is perpendicular to each of the bead thickness and the bead width, wherein the bead depth is selected from about 2 mm to about 10 mm;

(d) the separator beads are configured with a bead thickness-to-width aspect ratio selected from about 0.2 to about 0.9;

(e) the separator beads are optionally configured with one or more nodules, each with a nodule diameter selected from about 0.01 mm to about 2 mm; and (f) the separator beads are characterized by a thickness compression from about 5% to about 50%, under a load of 60 lb per separator bead, caused by the multiple layers, at a temperature of 120° F. for 5 minutes.

The multiple layers and the separator beads collectively form a system, as disclosed herein.

In some methods, the manufactured concrete products are installed at a jobsite, and the separator beads are partially or completely recycled and reused. In these or other methods, after the manufactured concrete products are installed at a jobsite, separator beads that are not recovered are environmentally biodegraded.

In preferred methods, the manufactured concrete products are installed at a jobsite, and the manufactured concrete products—after being installed—have essentially no surface scratches or defects due to the use of the separator beads.

Alternative geometries may be employed for the separator beads. Some embodiments provide a separator bead for separating layers of manufactured concrete products, wherein the separator bead is characterized in that:

(a) the separator bead is fabricated from a bead material;

(b) the separator bead is configured with a bead shape selected from the group consisting of UFO, OVAL, DUB, DB, EGG, and CAP, as depicted in FIG. 6;

(c) the separator bead is optionally configured with one or more nodules, each with a nodule diameter selected from about 0.01 mm to about 2 mm; and (d) the separator bead is characterized by a thickness compression from about 5% to about 50%, under a load of 60 lb at a temperature of 120° F. for 5 minutes.

BRIEF DESCRIPTION OF THE DRAWINGS

FIG. 3 shows a table of experimental data in Example 1.

DETAILED DESCRIPTION OF EMBODIMENTS

Figure 1:
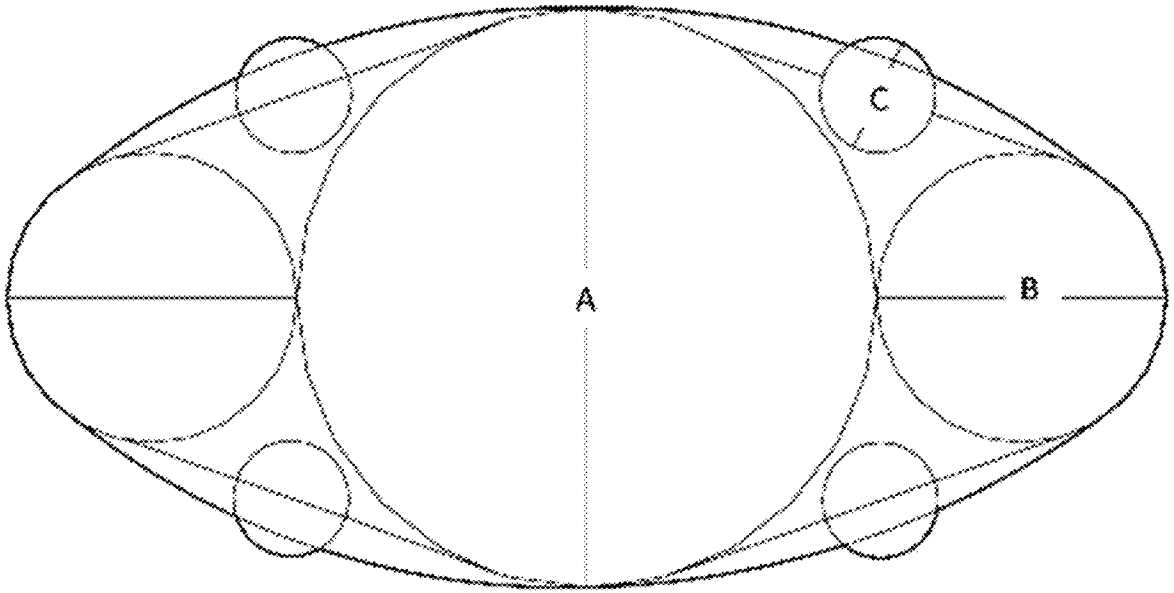
FIG. 1 depicts the shape of a two-dimensional cross-section of an oval-like separator bead, in some embodiments of the invention.

The structures, systems, and methods of the present invention will be described in detail by reference to various non-limiting embodiments.

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with the accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are ±5% of the value stated.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phrase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms, except when used in Markush groups. Thus in some embodiments not otherwise explicitly recited, any instance of "comprising" may be replaced by "consisting of" or, alternatively, by "consisting essentially of."

In this disclosure, a "unit" is synonymous with a "manufactured concrete product". As used in this specification, a "bead" is not intended to imply a particular geometry, but is a physically isolated object that is not a sheet and is significantly smaller than the maximum length scale of the unit (e.g., the length of a paver). When the present disclosure refers to the "top" of a bead and the "bottom" of a bead, it will be understood that this is in reference to a bead laying on a unit surface, with the top in a more-elevated position relative to the bottom.

In preferred embodiments, a separator bead has a three-dimensional (3D) shape that is characterized by an oval or oval-like two-dimensional (2D) elliptical shape. In this specification, an "oval" does not include a circle in which the major axis and minor axis are equal.

Some variations provide a separator bead for separating layers of manufactured concrete products, wherein the separator bead is characterized in that:

(a) the separator bead is fabricated from a bead material;

(b) the separator bead is configured with an oval or oval-like two-dimensional cross section defined by a bead thickness and a bead width, wherein the bead thickness is selected from about 2 mm to about 5 mm, and wherein the bead width is selected from about 2 mm to about 10 mm;

(c) the separator bead is configured with a bead depth that is perpendicular to each of the bead thickness and the bead width, wherein the bead depth is selected from about 2 mm to about 10 mm;

(d) the separator bead is configured with a bead thickness-to-width aspect ratio selected from about 0.2 to about 0.9;

(e) the separator bead is optionally configured with one or more nodules, each with a nodule diameter selected from about 0.01 mm to about 2 mm; and (f) the separator bead is characterized by a thickness compression from about 5% to about 50%, under a load of 60 lb at a temperature of 120° F. for 5 minutes.

Figure 2:
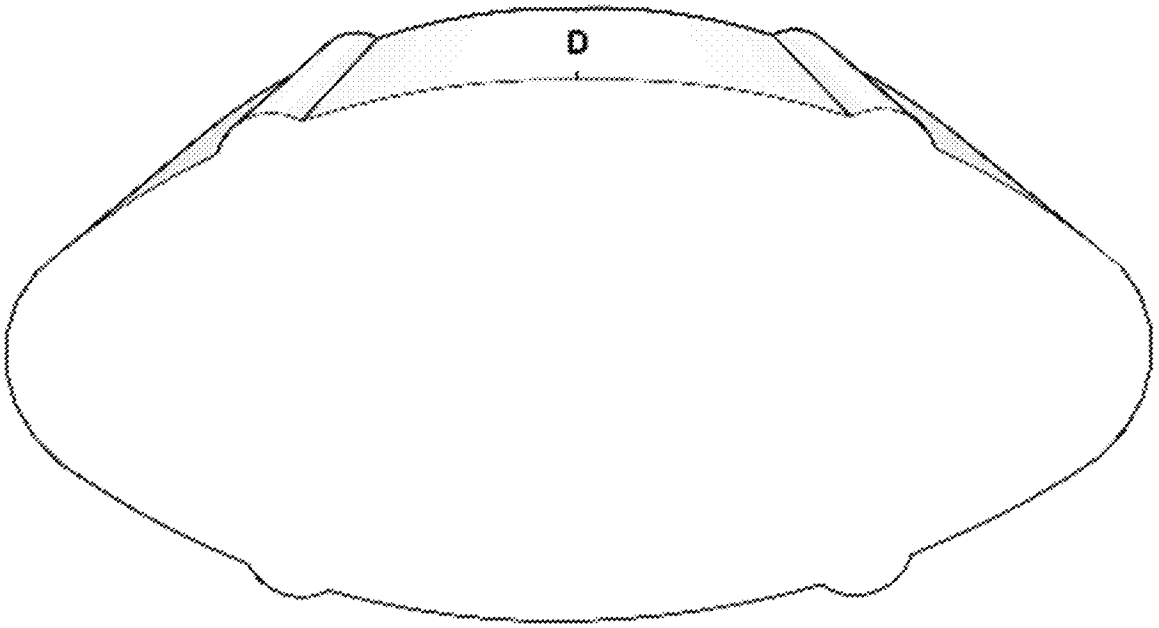
FIG. 2 depicts the depth of an oval-like separator bead, in some embodiments of the invention.

The geometric 3D configuration of a separator bead, according to some embodiments, can be understood with reference to FIGS. 1 and 2. FIG. 1 depicts the shape of a 2D cross-section of a separator bead, when viewed along the axis defined by the depth of the bead (dimension D in FIG. 2). In FIG. 1, an oval-like shape is defined by a major diameter A, a minor diameter B, and a nodule diameter C. The nodule diameter characterizes an optional surface feature, which for present purposes is referred to as a "nodule". The major diameter A is also referred to as the thickness of the separator bead. The minor diameter B is greater than 0 (since the bead is not spherical). The sum A+2B is the width of the separator bead. The depth D is shown in FIG. 2 and may also be referred to as the length of the separator bead.

The major diameter A (the bead thickness) may generally be selected from about 2 mm to about 5 mm. In some preferred embodiments, A is selected from about 2.5 mm to about 3 mm. In various embodiments, the major diameter A is about, at least about, or at most about 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.5, or 5.0 mm, including any intervening ranges (e.g., 2.4-3.0 mm).

The minor diameter B may generally be selected from about 0.5 mm to about 4.5 mm. In some preferred embodiments, B is selected from about 1 mm to about 2 mm. In various embodiments, the minor diameter B is about, at least about, or at most about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, or 4.5 mm, including any intervening ranges. In FIG. 1, the left-side minor diameter is not labeled but is generally equal to B. The B values on the left and right sides are the same when the oval is a perfect oval. In practice, the oval need not be a perfect oval, and the value of B may differ on the two sides. In this case, there is a B value as well as a B' value which represents the minor diameter on the left side. The value of B' is selected from the same range as the value of B, as disclosed above. Namely, in various embodiments, the minor diameter B' is about, at least about, or at most about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, or 4.5 mm, including any intervening ranges.

The width of the separator bead, A+2B (or A+B+B' when applicable), may generally be selected from about 2 mm to about 10 mm. In various embodiments, the bead width is about, at least about, or at most about 0.7, 1.0, 1.5, 2.0, 2.5, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.5, 6.0, 6.5, 7.0, 7.5, 8.0, 8.5, 9.0, 9.5, or 10.0 mm, including any intervening ranges.

Nodules may be used in the design of a separator bead to increase the coefficient of friction of the bead, to enhance the layer-separation function of the beads, among other potential reasons. The nodule diameter C may generally be selected from 0 (when there are no nodules) to about 2 mm. In some preferred embodiments, C is selected from about 0.1 mm to about 2.0 mm. In various embodiments, the nodule diameter C is about, at least about, or at most about 0.01, 0.02, 0.05, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, or 2.0 mm, including any intervening ranges. In FIG. 1, there are 4 nodules, which is exemplary (there may be a different number of nodules). In preferred embodiments, each nodule has the same or about the same nodule diameter C, as implied in FIG. 1. In other embodiments, the nodule diameters may differ, such that 4 nodules have diameters $C_1$, $C_2$, $C_3$, $C_4$, each of which may be generally be selected from 0 to about 2 mm.

The depth D of the separator bead may generally be selected from about 2 mm to about 10 mm. In various embodiments, the bead depth is about, at least about, or at most about 1.0, 1.5, 2.0, 2.5, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.5, 6.0, 6.5, 7.0, 7.5, 8.0, 8.5, 9.0, 9.5, or 10.0 mm, including any intervening ranges.

The separator bead may be characterized by a thickness-to-width aspect ratio A/(A+2B), or A/(A+B+B') when applicable. The thickness-to-width aspect ratio is less than 1 and may generally be selected from about 0.2 to about 0.9, such as from about 0.4 to about 0.7. In various embodiments, the thickness-to-width aspect ratio is about, at least about, or at most about 0.20, 0.25, 0.30, 0.35, 0.40, 0.41, 0.42, 0.43, 0.44, 0.45, 0.46, 0.47, 0.48, 0.49, 0.50, 0.51, 0.52, 0.53, 0.54, 0.55, 0.56, 0.57, 0.58, 0.59, 0.60, 0.61, 0.62, 0.63, 0.64, 0.65, 0.66, 0.67, 0.68, 0.69, 0.70, 0.75, 0.80, 0.85, or 0.90, including any intervening ranges. An example of a thickness-to-width aspect ratio of 0.5 is a bead thickness of 2.5 mm and a bead width of 5 mm. An example of a thickness-to-width aspect ratio of 0.2 is a bead thickness of 2 mm and a bead width of 10 mm. An example of a thickness-to-width aspect ratio of 0.9 is a bead thickness of 1.9 mm and a bead width of 2.1 mm. Note that in the latter case, both the bead thickness and bead width are 2 mm±0.1 mm (±5%), i.e., both about 2 mm.

When at least one nodule is present, the separator bead may be characterized by a nodule aspect ratio C/A. The nodule aspect ratio may generally be selected from about 0.01 to about 2. In various embodiments, the nodule aspect ratio is about, at least about, or at most about 0.001, 0.005, 0.01, 0.02, 0.03, 0.04, 0.05, 0.1, 0.15, 0.20, 0.25, 0.30, 0.35, 0.40, 0.45, 0.50, 0.60, 0.70, 0.80, 0.90, 1.0, 1.1, 1.2, 1.3, 1.4, 1.5, 1.6, 1.7, 1.8, 1.9, or 2.0.

The separator bead may also be characterized by a depth-to-thickness ratio D/A. The depth-to-thickness ratio may generally be selected from about 0.4 to about 10. In various embodiments, the depth-to-thickness ratio is about, at least about, or at most about 0.4, 0.5, 0.6, 0.7, 0.8, 0.9, 1, 1.5, 2, 2.5, 3, 3.5, 4, 4.5, 5, 6, 7, 8, 9, or 10.

The separator bead may also be characterized by a depth-to-width ratio D/(A+2B). The depth-to-width ratio may generally be selected from about 0.5 to about 5. In various embodiments, the depth-to-thickness ratio is about, at least about, or at most about 0.5, 0.6, 0.7, 0.8, 0.9, 1, 1.2, 1.2, 1.3, 1.4, 1.5, 1.6, 1.7, 1.8, 1.9, 2, 2.5, 3, 3.5, 4, 4.5, or 5.

The dimensions at the ends of the separator beads, along the depth axis, may vary. One or both ends may generally be flat or curved. In some embodiments, the separator beads have an ovoid (egg-like) 3D shape, in which both ends are rounded. In some embodiments, the separator beads have an elongated ovoid 3D shape, with rounded ends and a depth-to-thickness ratio greater than 1. Alternative bead shapes are discussed later in this specification, in reference to FIG. 6.

It should also be noted that there may be variations in dimensions, which may be unintentional or intentional. For example, within a plurality of separator beads, the dimensions (A, B, C, and D) may vary, in which case the values of A, B, C, and D are average values across all beads. Also, within a given separator bead, there may be variations for example in A, B, and C as a function of depth, in which case the values of A, B, and C are average values across the depth of the individual bead. It will also be appreciated that while the above dimensions are preferred, there may be smaller or larger irregularly shaped beads or particles present within a plurality of separator beads.

A concrete unit generally, although not necessarily, will have opposing planar surfaces. The planar surfaces may be completely flat, or there may be some curvature. Also, the planar surfaces may be smooth (e.g., polished) or may be rough (e.g., with intentional surface texture).

To perform successfully, the separator beads in various embodiments: (1) are preferably of such size that they hold the unit layers apart even if there is an uneven surface texture on the units; (2) preferably maintain their ability to separate the unit layers without adhering to the unit surface when subjected to the compressive loads and high temperatures experienced during transport and storage of pallets (or other means of containment) of units prior to installation; (3) preferably do not degrade prematurely due to exposure to moisture and high alkalinity associated with Portland cement-based products, which degradation may cause stains on the unit surface or an inability to continue to hold the unit layers apart; (4) preferably provide enough stability during transport of unit pallets (or other means of containment) to the jobsite, and during handling at the jobsite (e.g., when strapping is removed), so that the layers of units do not become unstable and slide off of the pallet; and (5) preferably have an optimized shape that allows air to circulate between the units layers without trapping moisture below the individual beads. Also, from a compositional perspective, the separator beads are preferably biodegradable so that any beads not collected at the jobsite during installation of the units would break down when exposed to the elements and therefore not contribute to permanent, non-degradable waste in the environment (e.g., in the ground or in the oceans). Potential bead compositions are disclosed later in this specification.

Preferred attributes (1)-(5) for the separator beads will now be further described.

(1) The beads are preferably of such size that they hold the unit layers apart even if there is an uneven surface texture on the units. In some embodiments, the separator beads have a thickness of between 2 mm and 4 mm, such as from 2.4 mm to 3.0 mm, to keep the layers separated which prevents scratching of the unit surfaces. These size ranges will accommodate the surface texture that is typically seen on architectural units. That is, when the length scale of surface texture is about 1 mm, separator beads with a thickness less than 1 mm may be physically lost within surface-texture regions. If the length scale of surface texture is even larger than 1 mm, then preferably the bead thickness is correspondingly larger. Conversely, if there is little or no surface texture, then the bead thickness may be about 1 mm, for example.

(2) The beads preferably maintain their ability to separate the unit layers without adhering to the unit surface when subjected to the compressive loads and high temperatures experienced during transport and storage of units prior to installation. In some embodiments, to perform adequately, the separator beads are able to withstand a load (force) of 60 lb/bead at a temperature of 120° F. sustained for 5 minutes without sticking to the unit surface. (In this disclosure, lb is $lb_f$, units of pound-force.) Some compression of the beads under a load is tolerable and even desirable, but preferably, the separator beads compress no more than 50% at 120° F. and/or no more than 40% at room temperature. Also preferably, under a load, the final thickness of the separator beads is at least about 1.5 mm at 120° F. and at least about 2 mm at room temperature.

(3) The beads preferably do not degrade prematurely due to exposure to moisture and high alkalinity associated with Portland cement—based products, which degradation may cause stains on the unit surface or an inability to continue to hold the unit layers apart. In some embodiments, to perform adequately, separator beads do not discolor when stored in cement-saturated water at 120° F. for 7 days.

(4) The beads preferably provide enough stability during transport of unit pallets to the jobsite, and during handling at the jobsite, so that the layers of units do not become unstable and slide off of the pallet. In some embodiments, to perform adequately, the separator beads (a) provide a coefficient of friction of at least 0.4 when sandwiched between units and (b) have a thickness-to-width aspect ratio of 0.4 to 0.7. Aspect ratios of greater than 0.7 tend to have low coefficients of friction. Aspect ratios of less than 0.4 tend to facilitate beads stacking on top of each other, resulting in an uneven separation between the concrete units.

(5) The beads preferably have an optimized shape that allows air to circulate between the units layers without trapping moisture below the individual beads. In some embodiments, to perform adequately, the separator beads have a shape that meets that attributes described in (1)-(4) and are not flat or concave. A flat or concave surface tends to trap water between the beads and the unit surface, leading to the formation of efflorescence. An especially preferred bead shape is a modified oval that is 2 mm to 3 mm in thickness, 3 mm to 6 mm in width, and 2 mm to 6 mm deep.

Even more preferred is a modified oval of similar dimensions with two nodules on the top and two modules on the bottom face of the bead.

The optional nodules give several benefits to the separator beads. In particular, the nodules act as feet and hands on the beads, provide extra rocking stability to the separator bead while spreading the load. In addition, the presence of nodules may reduce the trapping of water below a bead, since there will be open space in the interfacial area involving the unit surface, the nodule, and the rest of the bead surface. Also, nodules may promote air circulation which is beneficial.

When present, the number of nodules on an individual separator bead may vary, such as 1, 2, 3, 4, 5, 6, 7, 8, 9, 10, or more. In the illustration of FIGS. 1 and 2, there are 4 nodules-2 nodules on top and 2 nodules on bottom. The number of nodules on top of the bead may be the same as, or different than, the number of nodules on the bottom of the bead. Geometrically, the nodules may be continuous along the depth dimension, as depicted in FIG. 2, or they may be discontinuous and nodularized along the depth dimension as well, forming periodic lumps out of the surface of the bead.

It will also be appreciated that the nodules may themselves have various geometries. In the embodiment of FIGS. 1 and 2, the nodules are substantially cylindrical along the depth dimension, and have a circular 2D cross section. Other nodule geometries are possible, including but not limited to triangular, rectangular, square, pentagonal, hexagonal, irregular, or random. Combinations of nodule geometries may be employed, i.e., where there is more than one nodule per bead, there may be mixtures of nodule geometries. When then nodule does not form a circular 2D cross section, then the nodule diameter is the equivalent diameter. The equivalent diameter of a non-spherical nodule is the diameter of a sphere of equivalent volume to the actual nodule.

The composition of the separator beads may vary widely. Preferably, the composition is selected to enable the beads to be formed into the desired shape and to possess the desired properties (e.g., compressive strength, coefficient of friction, moisture stability, and resistance to alkalinity). Polymers are generally advantageous because they allow some compression (avoiding a ball-bearing effect) but not too much compression, and generally enable fabrication of specified 3D shapes, such as via polymer extrusion through a die. Metals, metal alloys, and ceramics are generally not preferred because they are too stiff (insufficient compression), are usually too hard (which tends to scratch, crack, or otherwise damage the unit surfaces), and can be difficult to fabricate into specified 3D shapes. Different materials may be employed for the separator bead composition, and the bead may have a uniform or graded concentration (e.g., a surface coating on a bulk material).

Preferably, the separator bead composition comprises, or consists essentially of, a biodegradable or compostable material. Separator beads may be fabricated from virgin biodegradable materials, recycled materials, or a combination thereof.

Note that some natural products contain biodegradable materials (e.g., cellulose) in addition to other components. For example, the separator beads may be fabricated from wood-derived pulp or biomass-derived pulp, which generally contains cellulose and varying levels of hemicellulose and lignin. Bleached pulp may be used, in which lignin has been largely removed or oxidized, and which may be beneficial to reduce straining. Molded pulp beads may be employed, in which the beads are molded into the desired shape, rather than in typical shapes for molded pulp (e.g., food holders). Also, wood or other lignocellulosic biomass may be employed to fabricate separator beads. Wood is well-known to be biodegradable in the environment.

In this specification, "biodegradable" separator beads means that the separator beads are capable of undergoing decomposition (fragmentation and assimilation) under the action of naturally occurring microorganisms, such as during composting. Biodegradation generally results in the formation of water, carbon dioxide, methane, and biomass. In some embodiments, biodegradability is measured according to ASTM D5988-18 "Standard Test Method for Determining Aerobic Biodegradation of Plastic Materials in Soil", which is hereby incorporated by reference. In some embodiments, biodegradability is measured according to ASTM D6954-18 "Standard Guide for Exposing and Testing Plastics that Degrade in the Environment by a Combination of Oxidation and Biodegradation", which is hereby incorporated by reference.

Preferably, the separator beads are fabricated from a bead material that is at least 50% biodegradable, more preferably at least 75% biodegradable, even more preferably at least 90% biodegradable, most preferably at least 95% biodegradable, such as 99%, 99.5%, 99.9%, or 100% biodegradable, according to ASTM D5988-18, ASTM D6954-18, or another test method specified by ASTM or another standards organization.

In less-preferred embodiments, the separator beads include or consist essentially of a non-biodegradable material, such as polyethylene, polypropylene, polyethylene terephthalate, polystyrene, etc. Again, separator beads may be fabricated from virgin polymer resins, recycled plastics, or a combination thereof. For example, separator beads may be made from recycled polyethylene terephthalate from beverage containers.

Optionally, various additives may be included in the bead material. Additives may be added to adjust density, viscosity, compressibility, chemical reactivity (e.g., alkaline reactivity), moisture reactivity, coefficient of friction, stickiness to concrete materials, porosity, and color, for example. Preferably, when biodegradable beads are desired, any additives are also biodegradable or compostable.

The separator beads themselves may be recovered and reused in another separation of concrete units. This is especially preferred when non-biodegradable materials are utilized for the separator beads. When the separator beads are fabricated from biodegradable materials, it is still beneficial to collect and reuse the beads for cost reasons. Biodegradable separator beads that are not collected, however, will cause less harm to the environment.

When a plurality of separator beads is provided for use in separating unit layers, the separator beads may be applied between successive layers with a range of area densities. For example, the density of beads may be selected from about 0.01 bead per square inch to about 10 beads per square inch (area of unit surface perpendicular to direction of stacking). In various embodiments, the density of separator beads is about, at least about, or at most about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2, 2.5, 3, 3.5, 4, 5, 6, 7, 8, 9, or 10 beads per square inch. The distribution of separator beads across the surface may be uniform or non-uniform (e.g., randomly dispersed). Typically, a supply of separator beads is poured onto a unit layer, which results in a random placement of beads across the surface. It is possible that some beads are next to each other, and possibly touching. Preferably, all separator beads lay on the surface such that the width and depth axes are both substantially parallel to the surface, and the thickness is substantially perpendicular to the surface.

Certain variations provide a separator bead for separating layers of manufactured concrete products, wherein the separator bead is characterized in that:

(a) the separator bead is fabricated from a bead material;

(b) the separator bead is configured with an oval or oval-like two-dimensional cross section defined by a bead thickness and a bead width, wherein the bead thickness is selected from about 0.5 mm to about 10 mm, and wherein the bead width is selected from about 1 mm to about 20 mm;

(c) the separator bead is configured with a bead depth that is perpendicular to each of the bead thickness and the bead width, wherein the bead depth is selected from about 1 mm to about 20 mm;

(d) the separator bead is configured with a bead thickness-to-width aspect ratio selected from about 0.2 to about 0.9; and (e) the separator bead is configured with one or more nodules, each with a nodule diameter selected from about 0.01 mm to about 5 mm.

Some variations of the invention provide a system comprising multiple layers of manufactured concrete products and a plurality of separator beads disposed between each of the multiple layers, wherein the plurality of separator beads is characterized in that:

(a) the separator beads are fabricated from a bead material;

(b) the separator bead are configured with an oval or oval-like two-dimensional cross section defined by a bead thickness and a bead width, wherein the bead thickness is selected from about 2 mm to about 5 mm, and wherein the bead width is selected from about 2 mm to about 10 mm;

(c) the separator beads are configured with a bead depth that is perpendicular to each of the bead thickness and the bead width, wherein the bead depth is selected from about 2 mm to about 10 mm;

(d) the separator beads are configured with a bead thickness-to-width aspect ratio selected from about 0.2 to about 0.9;

(e) the separator beads are optionally configured with one or more nodules, each with a nodule diameter selected from about 0.01 mm to about 2 mm; and (f) the separator beads are characterized by a thickness compression from about 5% to about 50%, under a load of 60 lb at a temperature of 120° F. for 5 minutes.

In typical embodiments, the multiple layers are disposed in a vertically stacked arrangement. The number of layers may vary, such as at least 2, 3, 4, 5, 6, 7, 8, 9, 10, 11, 12, 13, 14, 15, 15, 16, 17, 18, 19, 20, or more, for example.

In preferred embodiments, the separator beads do not significantly trap moisture between the separator beads and surfaces of the manufactured concrete products. In preferred embodiments, the multiple layers are sufficiently separated by the separator beads to enable drying via air circulation, thereby avoiding efflorescence.

In some systems, the separator beads are characterized by a coefficient of friction, relative to a surface of the manufactured concrete products, of at least about 0.4, such as at least about 0.5 or at least about 0.6.

In some systems, the separator beads are disposed between each of the multiple layers with a bead density of from about 0.01 to about 10 beads per square inch of layer area.

In some systems, the bead thickness is selected from about 2 mm to about 4 mm, such as from about 2.4 mm to about 3.5 mm. In some systems, the bead width is selected from about 3 mm to about 6 mm, such as from about 4 mm to about 5 mm. In some systems, the bead depth is selected from about 2 mm to about 8 mm, such as from about 3 mm to about 6 mm. The bead thickness-to-width aspect ratio may be selected from about 0.4 to about 0.7, such as from about 0.4 to about 0.6, or from about 0.45 to about 0.55. The separator beads may be characterized by a depth-to-thickness ratio selected from about 0.4 to about 10 and/or a depth-to-width ratio selected from about 0.5 to about 5.

Unless otherwise stated, separator-bead geometric parameters are averaged across all separator beads present in the system.

In some systems, some or all of the separator beads are configured with one or more nodules, such as at least 2, at least 4, or at least 6 nodules. The nodule diameter may be selected from about 0.1 mm to about 1 mm, such as from about 0.2 mm to about 0.8 mm. The nodule aspect ratio (nodule diameter/bead thickness) may be selected from about 0.01 to about 2, such as from about 0.05 to about 1, or from about 0.1 to about 0.5.

In preferred systems of the invention, the bead material includes a biodegradable or compostable material, and more preferably consists essentially of a biodegradable or compostable material.

The separator beads (or a majority thereof) are preferably each capable of withstanding a load of 60 lb at a temperature of 120° F. for 5 minutes. In some systems, the separator beads are each characterized by a thickness compression of about 40% or less, such as about 30% or less, about 20% or less, or about 10% or less, under a load caused by the multiple layers, at room temperature (about 70° F.) for 5 minutes. In certain systems, the separator beads are each characterized by a thickness compression selected from about 1% to about 40%, such as from about 5% to about 30%, or from about 10% to about 20%, under a load caused by the multiple layers, at room temperature for 5 minutes. The "thickness compression" is the percent reduction of initial thickness of separator bead under a given load; thickness compression is a compression in one dimension, not a volumetric compression.

Note that the temperatures and times for load tests do not imply that the separator beads must be actually used at such temperatures and times, but rather that the separator beads are characterized by these compression properties. See Example 3 and FIG. 3. The force of 60 lb per bead is specified for the property test because it is believed that such force is typical of that imposed on beads by layers of manufactured concrete products, each separated by the separator beads disclosed herein. Also, both room temperature (70° F.) and 120° F. are specified due to a realistic range of temperatures for which the manufactured concrete products will likely be stored. The time of 5 minutes is specified to provide a definite load test, but again, the actual time that the separator beads will be under real load will likely be different than 5 minutes, and usually much longer.

The separator beads are preferably characterized by no discoloration when stored in cement-saturated water at 120° F. for 7 days. This property is an indicator that the separator beads will not discolor (stain) surfaces of the manufactured concrete products during transport and storage.

Systems may be designed using known engineering principles and tools, such as (but not limited to) simulation of mass and heat transport, finite element analysis, statistical analysis, kinetic analysis, equilibrium analysis, and the like. Systems may be designed with the aid of prototypes.

Other variations provide a method of stacking multiple layers of manufactured concrete products, the method comprising:

providing manufactured concrete products;

stacking the manufactured concrete products into multiple layers; and between each of the multiple layers, introducing a plurality of separator beads, wherein each of the plurality of separator beads is characterized in that:

(a) the separator beads are fabricated from a bead material;

(b) the separator bead are configured with an oval or oval-like two-dimensional cross section defined by a bead thickness and a bead width, wherein the bead thickness is selected from about 2 mm to about 5 mm, and wherein the bead width is selected from about 2 mm to about 10 mm;

(c) the separator beads are configured with a bead depth that is perpendicular to each of the bead thickness and the bead width, wherein the bead depth is selected from about 2 mm to about 10 mm;

(d) the separator beads are configured with a bead thickness-to-width aspect ratio selected from about 0.2 to about 0.9;

(e) the separator beads are optionally configured with one or more nodules, each with a nodule diameter selected from about 0.01 mm to about 2 mm; and (f) the separator beads are characterized by a thickness compression from about 5% to about 50%, under a load of 60 lb per separator bead, caused by the multiple layers, at a temperature of 120° F. for 5 minutes.

The multiple layers and the separator beads collectively form a system, as disclosed above and herein.

In some methods, the manufactured concrete products are installed at a jobsite, and the separator beads are partially or completely recycled and reused. In these or other methods, after the manufactured concrete products are installed at a jobsite, separator beads that are not recovered are environmentally biodegraded.

In preferred methods, the manufactured concrete products are installed at a jobsite, and the manufactured concrete products, after being installed, have essentially no surface scratches or defects due to the use of the separator beads.

Figure 6:
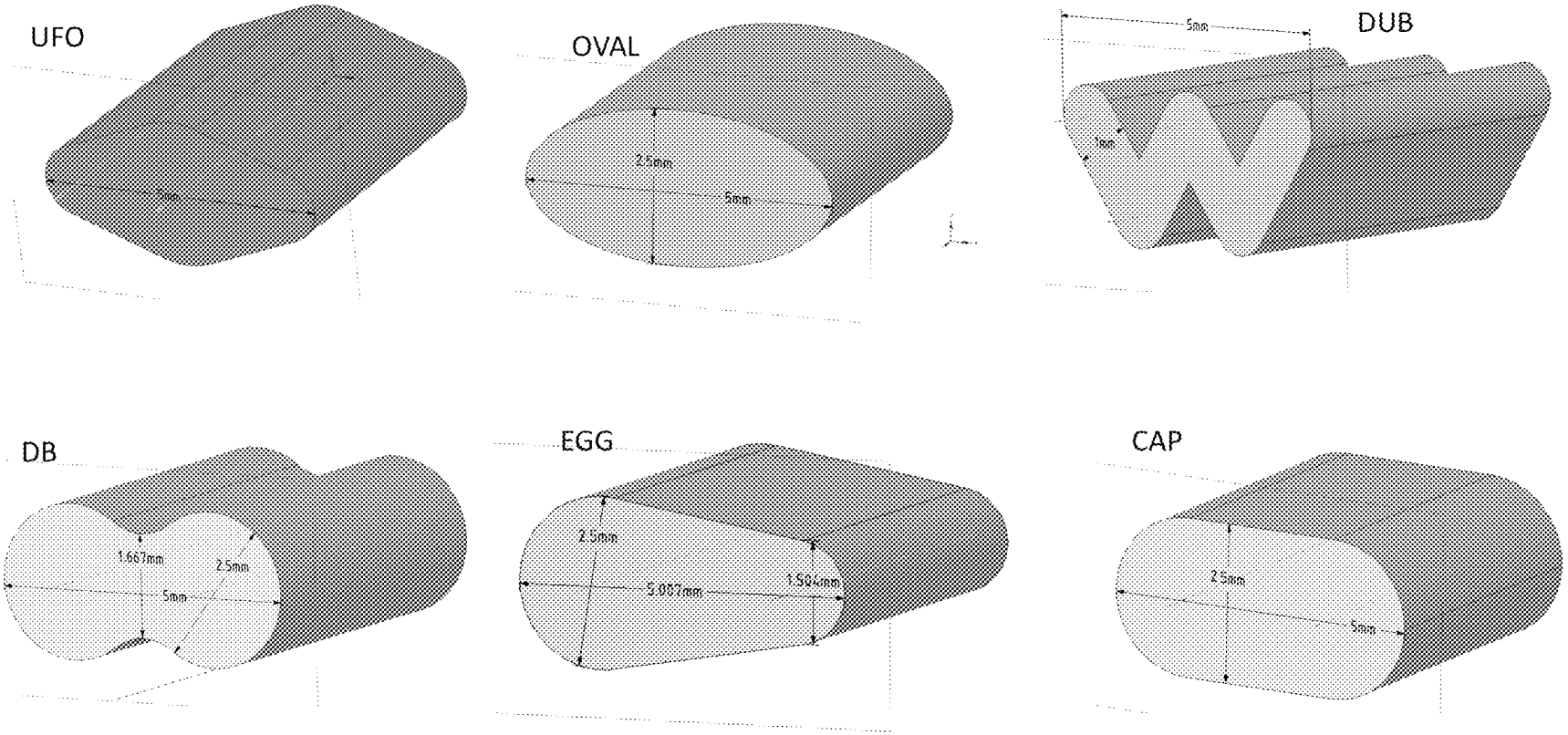
FIG. 6 depicts various geometries for separator beads in different embodiments of this disclosure.

The shape of the separator bead may be different than an oval, in certain embodiments. FIG. 6 depicts various geometries for separator beads. Some embodiments thus provide a separator bead for separating layers of manufactured concrete products, wherein the separator bead is characterized in that:

(a) the separator bead is fabricated from a bead material;

(b) the separator bead is configured with a bead shape selected from the group consisting of UFO, OVAL, DUB, DB, EGG, and CAP, as depicted in FIG. 6;

(c) the separator bead is optionally configured with one or more nodules, each with a nodule diameter selected from about 0.01 mm to about 2 mm; and (d) the separator bead is characterized by a thickness compression from about 5% to about 50%, under a load of 60 lb at a temperature of 120° F. for 5 minutes.

In certain alternative embodiments, a separator bead is provided for separating layers of manufactured concrete products, wherein the separator bead is characterized in that:

(a) the separator bead is fabricated from a bead material;

(b) the separator bead is configured with a bead shape selected from the group consisting of UFO, DUB, DB, EGG, and CAP, as depicted in FIG. 6;

(c) the separator bead is optionally configured with one or more nodules, each with a nodule diameter selected from about 0.01 mm to about 2 mm; and (d) the separator bead is characterized by a thickness compression from about 5% to about 50%, under a load of 60 lb at a temperature of 120° F. for 5 minutes.

In FIG. 6, each separator bead is shown as having a bead width of about 5 mm, but 5 mm is exemplary only. The dimensions of the OVAL shape have been described in detail above. Generally, for the alternative shapes (UFO, DUB, DB, EGG, or CAP), the bead width may be selected from about 2 mm to about 10 mm. The bead thickness may be selected from about 1 mm to about 5 mm. The bead depth may be selected from about 2 mm to about 10 mm. Each of the bead width, thickness, and depth may vary as a function of position in the bead. For example, for the DB (double barrel) bead shape, the thickness at the center of the bead is lower than the maximum thickness defined by the barrel diameters. For the EGG bead shape, the thickness on one side is much higher than the thickness on the other side. Other length scales can be identified; for example, in the DUB shape, in addition to bead height, there is a length scale of material thickness, which is shown as 1 mm in the example of FIG. 6. Any of the separator beads depicted in FIG. 6 may be modified to include one or more nodules. Also, the thickness compression properties for the alternative bead shapes may be the same as those described above for the preferred oval or oval-like separator beads. Finally, multiple separator bead shapes may be employed. For example, both OVAL and CAP shapes may be used in a system utilizing separator beads.

EXAMPLES

Eight distinct separator beads are evaluated based on weight, shape, color, hardness, staining potential, compressibility, and slide resistance. The experimental data is summarized in FIG. 3.

Example 1: Testing of Preferred Separator Beads

Material A shown in the table of FIG. 3 is a biodegradable material selected such that the bead does not leave a stain when wet, does not overly compress when weight is applied, and does not adhere to the surface when in use. The bead's physical design allows it to keep layers (of manufactured concrete products) from interacting and to provide stability to the layers to prevent free movement of the units while in transit. The physical design of the separator bead is extrapolated from design flaws observed in conventional materials. These flaws include staining, adhesion, and non-optimal compressibility. Taking these into consideration, the bead's design for Material A is a modified oval with two nodules on the top and two nodules on the bottom face of the bead. The oval design allows for better interaction with uneven surfaces, and the nodules act as feet and hands to provide support and spread the load while still allowing for air circulation. The bead thickness is 2.6 mm, the bead width is 5.3 mm, and the bead length (depth) is 3.4 mm. The nodule diameter is about 0.5 mm. The thickness-to-width aspect ratio is 0.49 and the coefficient of friction is 0.61. The compressibility (percent reduction of thickness under load) is 11% at room temperature and 17% at 120° F. No staining in cement-saturated water is observed.

Material B shown in the table of FIG. 3 is a similar biodegradable material as Material A. The physical design of the Material B bead is similar to that for Material A, includes the nodules. The bead thickness is 2.4 mm, the bead width is 4.8 mm, and the bead length (depth) is 3.5 mm. The aspect ratio is 0.49 and the coefficient of friction is 0.64. The compressibility is (reduction of thickness under load) is 8% at room temperature and 12% at 120° F. No staining in cement-saturated water is observed.

Example 2: Staining Potential of Separator Beads

Staining potential is evaluated by placing beads in water-only tubes as well as tubes containing water and cement, and placing these tubes in a 120° F. (49° C.) chamber. Each tube is monitored for visible degradation, adhesion, and color changes of the water.

Figure 4:
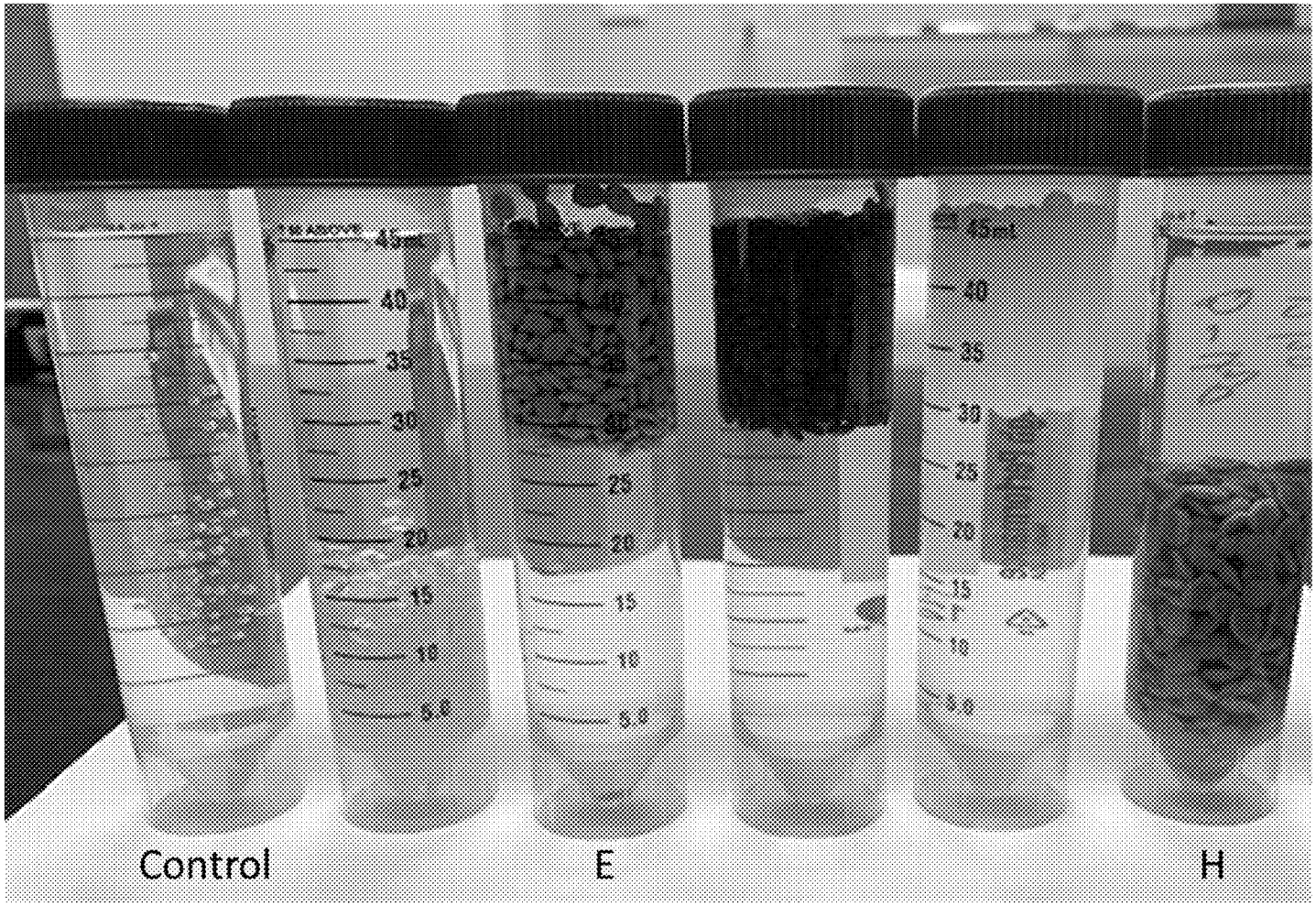
FIG. 4 shows a bead stain evaluation in which beads are stored in water at 49° C. (120° F.) for 18 days, for a biodegradable material in Example 2.

FIG. 4 shows a bead stain evaluation in which beads are stored in water at 120° F. for 18 days.

Figure 5:
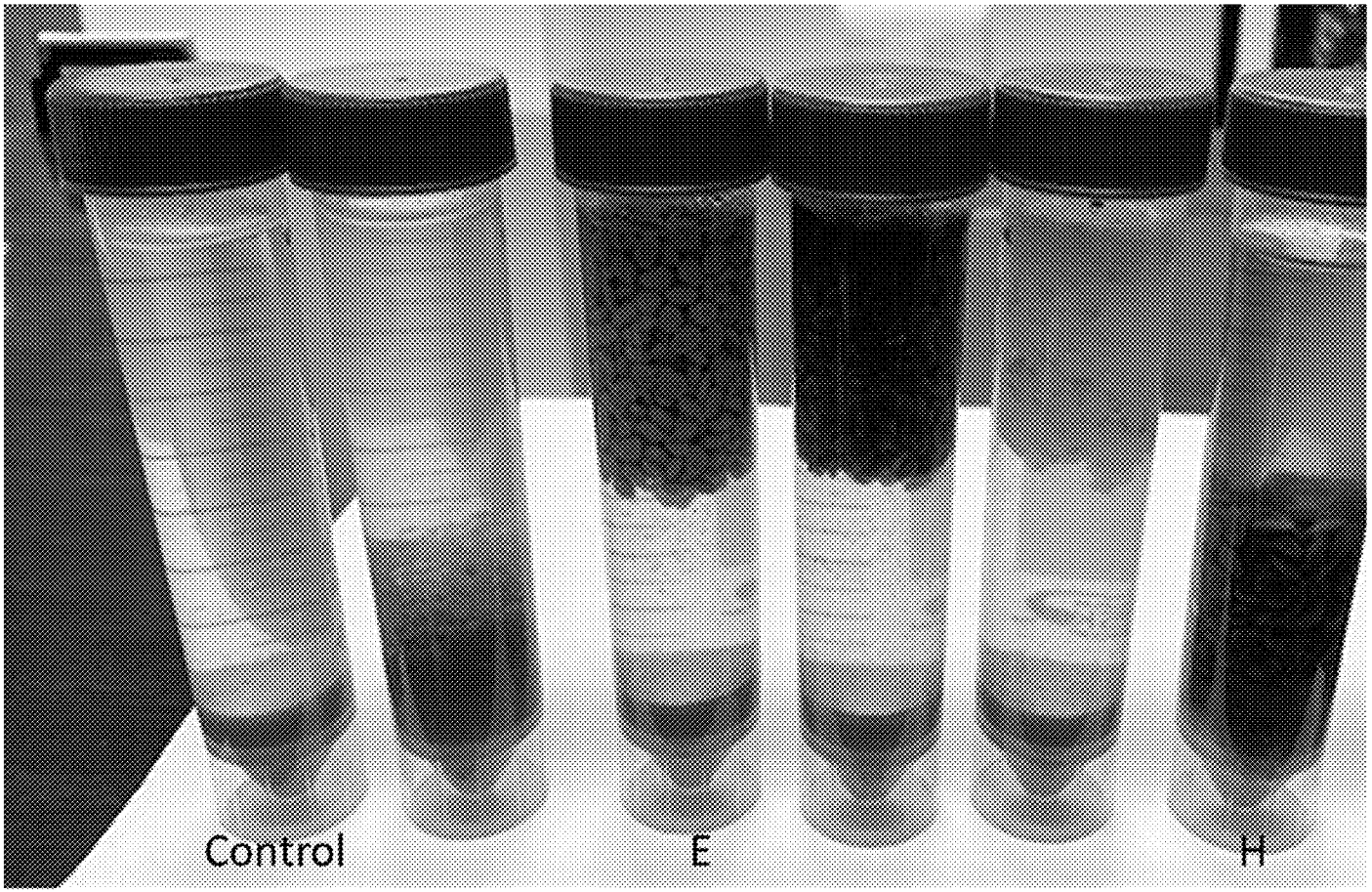
FIG. 5 shows a bead stain evaluation in which beads are stored in cement-containing water at 49° C. (120° F.) for 18 days, for a biodegradable material in Example 2.

FIG. 5 shows a bead stain evaluation in which beads are stored in cement-containing water at 120° F. for 18 days.

As can be seen in the pictures of FIGS. 4 and 5, and the table in FIG. 3, the composition of the bead has an effect on the staining potential. When exposed to the harsher, higher pH of the cement/water liquid, leaching is more pronounced, and the solution is a darker brown.

Example 3: Compression of Separator Beads

Compression is evaluated as the separator beads are intended to be used (sandwiched between cement units) including exposure to high heat under a high load. This involves using an oven and a concrete compression machine. First, the beads and concrete units are placed in a 120° F. oven overnight so that they are warm when tested. When tested, beads are placed between two flat units of concrete, each approximately 32 square inches in surface area, in such a way as to keep the beads one inch apart (approximately one bead per square inch). The unit sandwich is made by stacking the units as they would be stacked in a cube, with the bottom of the unit above the face of the unit below. In order to keep the units from shifting during compression and losing any beads, Gorilla tape is wrapped around the intersection of the units. With the sandwich complete, the units are quickly transferred to a compression machine in order to keep the units as warm as possible. Typically, a concrete press machine is operated with an ever-increasing load applied until failure. For this test, the machine is held at 2000 lb for 5 minutes; the 2000 lb overall load is equivalent to approximately 60 lb per bead. After the time has elapsed, the load is removed, the unit is disassembled, and the pellets are measured for changes in thickness as compared to the initial thickness.

As shown in FIG. 3, material A undergoes 11% thickness compression at a force of 2000 lb for 5 minutes at room temperature (about 70° F.), and 17% thickness compression at a force of 2000 lb for 5 minutes at 120° F. Material B undergoes 8% thickness compression at a force of 2000 lb for 5 minutes at room temperature (about 70° F.), and 12% thickness compression at a force of 2000 lb for 5 minutes at 120° F. Material C undergoes 4% thickness compression at a force of 2000 lb for 5 minutes at room temperature (about 70° F.), and 25% thickness compression at a force of 2000 lb for 5 minutes at 120° F. Material D undergoes 2% thickness compression at a force of 2000 lb for 5 minutes at room temperature (about 70° F.), and 16% thickness compression at a force of 2000 lb for 5 minutes at 120° F. Material E undergoes 13% thickness compression at a force of 2000 lb for 5 minutes at room temperature (about 70° F.), and 19% thickness compression at a force of 2000 lb for 5 minutes at 120° F. Material F undergoes 11% thickness compression at a force of 2000 lb for 5 minutes at room temperature (about 70° F.), and 17% thickness compression at a force of 2000 lb for 5 minutes at 120° F. Material G undergoes 29% thickness compression at a force of 2000 lb for 5 minutes at room temperature (about 70° F.), and 36% thickness compression at a force of 2000 lb for 5 minutes at 120° F. Material H undergoes 11% thickness compression at a force of 2000 lb for 5 minutes at room temperature (about 70° F.), and 16% thickness compression at a force of 2000 lb for 5 minutes at 120° F.

According to these results, the higher the pressure and temperature, the more compressed are the pellets.

Example 4: Coefficient of Friction of Separator Beads

In order to determine the potential for the bead's design to create an undesirable situation where the bead will act like a ball bearing and cause movement of the unit layers, a test is developed based on inclined-plane testing for determining friction force. Two pavers are placed on top of each other with beads between. This assembly is placed on a board and the board raised until the top unit slides over the bottom unit. A wooden structure is constructed with two boards connected by a hinge. A stop is installed in order to prevent only the bottom unit from moving. As the board is raised, the height of the incline is measured. At the moment of slip, the height is measured and converted to an angle, which is then converted into an observed coefficient of friction using well-known physics principles. As can be seen in the data in FIG. 3, there are some beads with a better design for slippage. When compared to the aspect ratio, there is some correlation with coefficient of friction. Separator beads that are more round (aspect ratio greater than 0.7) have lower friction force values than those with an aspect ratios less than 0.7 (shorter and wider). This data supports the optimal bead shape design, including an aspect ratio of about 0.5 in order to minimize the movement the layers when the units are packaged.

In this detailed description, reference has been made to multiple embodiments and to the accompanying drawings in which are shown by way of illustration specific exemplary embodiments of the invention. These embodiments are described in sufficient detail to enable those skilled in the art to practice the invention, and it is to be understood that modifications to the various disclosed embodiments may be made by a skilled artisan.

Where methods and steps described above indicate certain events occurring in certain order, those of ordinary skill in the art will recognize that the ordering of certain steps may be modified and that such modifications are in accordance with the variations of the invention. Additionally, certain steps may be performed concurrently in a parallel process when possible, as well as performed sequentially.

All publications, patents, and patent applications cited in this specification are herein incorporated by reference in their entirety as if each publication, patent, or patent application were specifically and individually put forth herein.

The embodiments, variations, and figures described above should provide an indication of the utility and versatility of the present invention. Other embodiments that do not provide all of the features and advantages set forth herein may also be utilized, without departing from the spirit and scope of the present invention. Such modifications and variations are considered to be within the scope of the invention defined by the claims.

What is claimed is:

1. A separator bead for separating layers of manufactured concrete products, wherein said separator bead is characterized in that:

(a) said separator bead is fabricated from a bead material;

(b) said separator bead is configured with an oval or oval-like two-dimensional cross section defined by a bead thickness and a bead width, wherein said bead thickness is selected from about 2 mm to about 5 mm, and wherein said bead width is selected from about 2 mm to about 10 mm;

(c) said separator bead is configured with a bead depth that is perpendicular to each of said bead thickness and said bead width, wherein said bead depth is selected from about 2 mm to about 10 mm;

(d) said separator bead is configured with a bead thickness-to-width aspect ratio selected from about 0.2 to about 0.9;

(e) said separator bead is configured with two or more nodules, each with a nodule diameter selected from about 0.1 mm to about 1 mm; and (f) said separator bead is characterized by a thickness compression from about 5% to about 50%, under a load of 60 lb at a temperature of 120° F. for 5 minutes.

2. The separator bead of claim 1, wherein said bead thickness is selected from about 2 mm to about 4 mm.

3. The separator bead of claim 2, wherein said bead thickness is selected from about 2.4 mm to about 3.5 mm.

4. The separator bead of claim 1, wherein said bead width is selected from about 3 mm to about 6 mm.

5. The separator bead of claim 4, wherein said bead width is selected from about 4 mm to about 5 mm.

6. The separator bead of claim 1, wherein said bead depth is selected from about 2 mm to about 8 mm.

7. The separator bead of claim 6, wherein said bead depth is selected from about 3 mm to about 6 mm.

8. The separator bead of claim 1, wherein said bead thickness-to-width aspect ratio is selected from about 0.4 to about 0.7.

9. The separator bead of claim 8, wherein said bead thickness-to-width aspect ratio is selected from about 0.4 to about 0.6.

10. The separator bead of claim 9, wherein said bead thickness-to-width aspect ratio is selected from about 0.45 to about 0.55.

11. The separator bead of claim 1, wherein said separator bead is characterized by a depth-to-thickness ratio selected from about 0.4 to about 10.

12. The separator bead of claim 1, wherein said separator bead is characterized by a depth-to-width ratio selected from about 0.5 to about 5.

13. The separator bead of claim 1, wherein said separator bead is configured with at least 4 nodules.

14. The separator bead of claim 1, wherein said nodule diameter is selected from about 0.2 mm to about 0.8 mm.

15. The separator bead of claim 1, wherein said separator bead is characterized by a nodule aspect ratio selected from about 0.01 to about 2.

16. The separator bead of claim 15, wherein said nodule aspect ratio is selected from about 0.05 to about 1.

17. The separator bead of claim 16, wherein said nodule aspect ratio is selected from about 0.1 to about 0.5.

18. The separator bead of claim 1, wherein said bead material includes a biodegradable or compostable material.

19. The separator bead of claim 18, wherein said bead material consists essentially of a biodegradable or compostable material.

20. The separator bead of claim 1, wherein said separator bead is characterized by a thickness compression from about 10% to about 40%, under a load of 60 lb at a temperature of 120° F. for 5 minutes.

21. The separator bead of claim 1, wherein said separator bead is characterized by a thickness compression from about 1% to about 40%, under a load of 60 lb at room temperature for 5 minutes.

22. The separator bead of claim 21, wherein said separator bead is characterized by a thickness compression from about 5% to about 30%, under a load of 60 lb at room temperature for 5 minutes.

23. The separator bead of claim 1, wherein said separator bead is characterized by no discoloration when stored in cement-saturated water at 120° F. for 7 days.

* * * * *